US009879553B2

(12) United States Patent
Shi et al.

(10) Patent No.: US 9,879,553 B2
(45) Date of Patent: Jan. 30, 2018

(54) FIXED BLADE ASSEMBLY USABLE IN EXHAUST PUMP, AND EXHAUST PUMP PROVIDED WITH SAME

(75) Inventors: Yongwei Shi, Chiba (JP); Yoshihiro Enomoto, Chiba (JP); Manabu Nonaka, Chiba (JP)

(73) Assignee: Edwards Japan Limited, Chiba (JP)

( * ) Notice: Subject to any disclaimer, the term of this patent is extended or adjusted under 35 U.S.C. 154(b) by 1030 days.

(21) Appl. No.: 13/990,998

(22) PCT Filed: Sep. 13, 2011

(86) PCT No.: PCT/JP2011/070800
§ 371 (c)(1),
(2), (4) Date: May 31, 2013

(87) PCT Pub. No.: WO2012/081287
PCT Pub. Date: Jun. 21, 2012

(65) Prior Publication Data

US 2014/0010659 A1 Jan. 9, 2014

(30) Foreign Application Priority Data

Dec. 14, 2010 (JP) ..... 2010-278153

(51) Int. Cl.
*F01D 9/02* (2006.01)
*F04D 19/04* (2006.01)
*F04D 29/54* (2006.01)

(52) U.S. Cl.
CPC ..... *F01D 9/02* (2013.01); *F04D 19/042* (2013.01); *F04D 29/542* (2013.01)

(58) Field of Classification Search
CPC .... F01D 11/005; F01D 11/006; F01D 11/008; F01D 9/041; F04D 19/042; F05D 2230/54
See application file for complete search history.

(56) References Cited

U.S. PATENT DOCUMENTS 4,561,670 A * 12/1985 Takada ..... B29C 66/1122 280/281.1
5,158,426 A * 10/1992 Casaro ..... F04D 19/042 403/340
2007/0231992 A1* 10/2007 Balasubramaniam .. G03F 7/427 438/227

FOREIGN PATENT DOCUMENTS

JP 9-303288 A 11/1997
JP 2003-269365 A 9/2003
(Continued)

OTHER PUBLICATIONS

International Search Report and Written Opinion dated Dec. 13, 2011 for corresponding International Application No. PCT/JP2011/070800, filed Sep. 13, 2011.
(Continued)

*Primary Examiner* — Nathaniel Wiehe
*Assistant Examiner* — Brian O Peters
(74) *Attorney, Agent, or Firm* — Theodore M. Magee; Westman, Champlin & Koehler, P.A.

(57) ABSTRACT

Provided are a stator blade assembly advantageous for improving the evacuation performance by shortening the evacuation time, and an exhaust pump provided with such a stator blade assembly. Inner and outer stator blade bases of a plurality of stator blades are supported by frames. A projecting portion protruding from the frame supporting the inner stator blade base, or from the frame supporting the outer stator blade base, or from both of the frames is provided in a gap in the vicinity of the inner or outer stator blade base between one of the supported stator blades and the stator blade transversely adjacent thereto.

9 Claims, 11 Drawing Sheets

(56) References Cited

FOREIGN PATENT DOCUMENTS

| | | | |
|---|---|---|---|
| JP | 2005-337028 | A | 12/2005 |
| JP | 2005337028 | * | 12/2005 |

OTHER PUBLICATIONS

Notification of Reasons for Refusal dated May 28, 2015 for corresponding Japanese Application No. JP2012-548687.

* cited by examiner

[FIG.1]
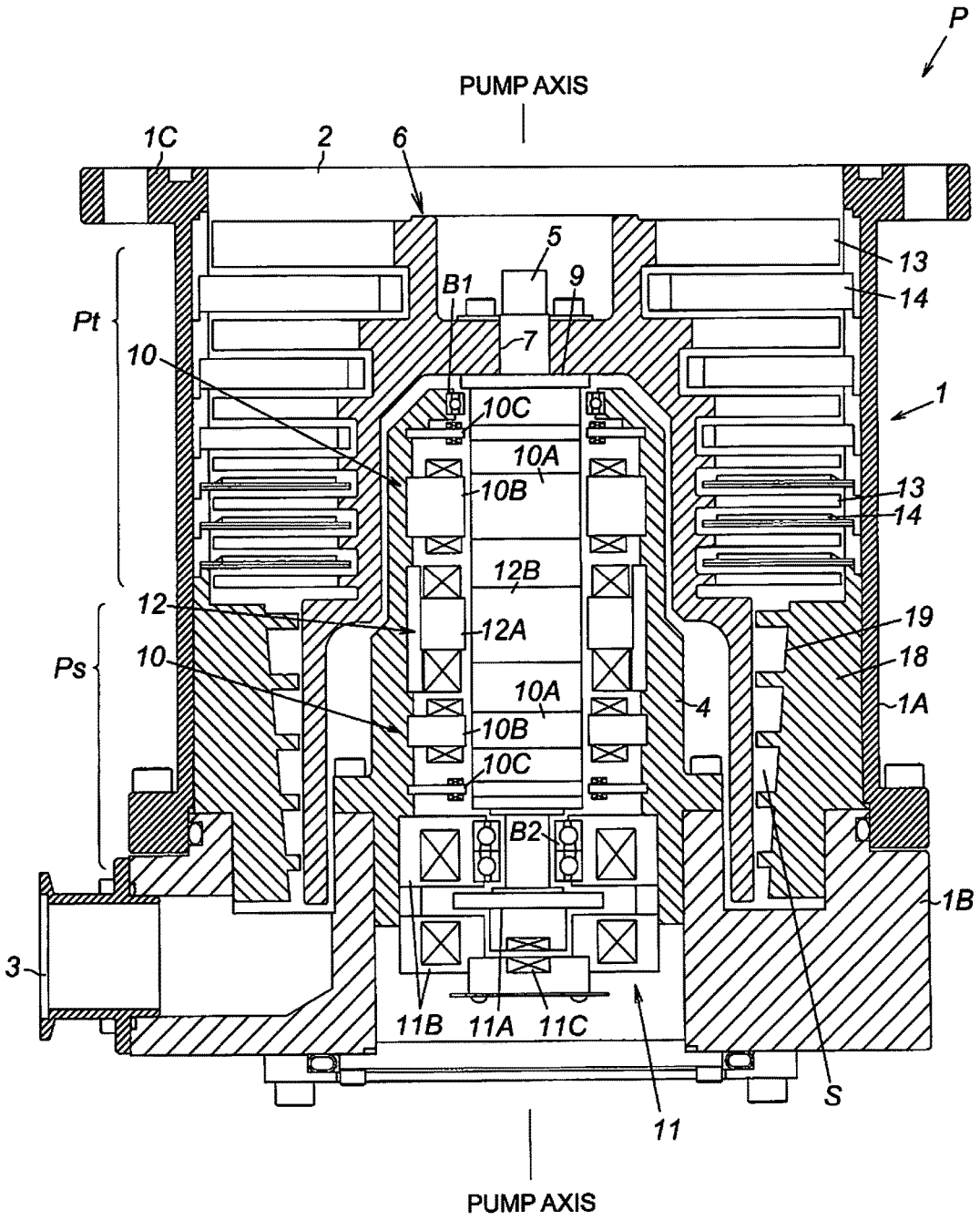

[FIG.2]
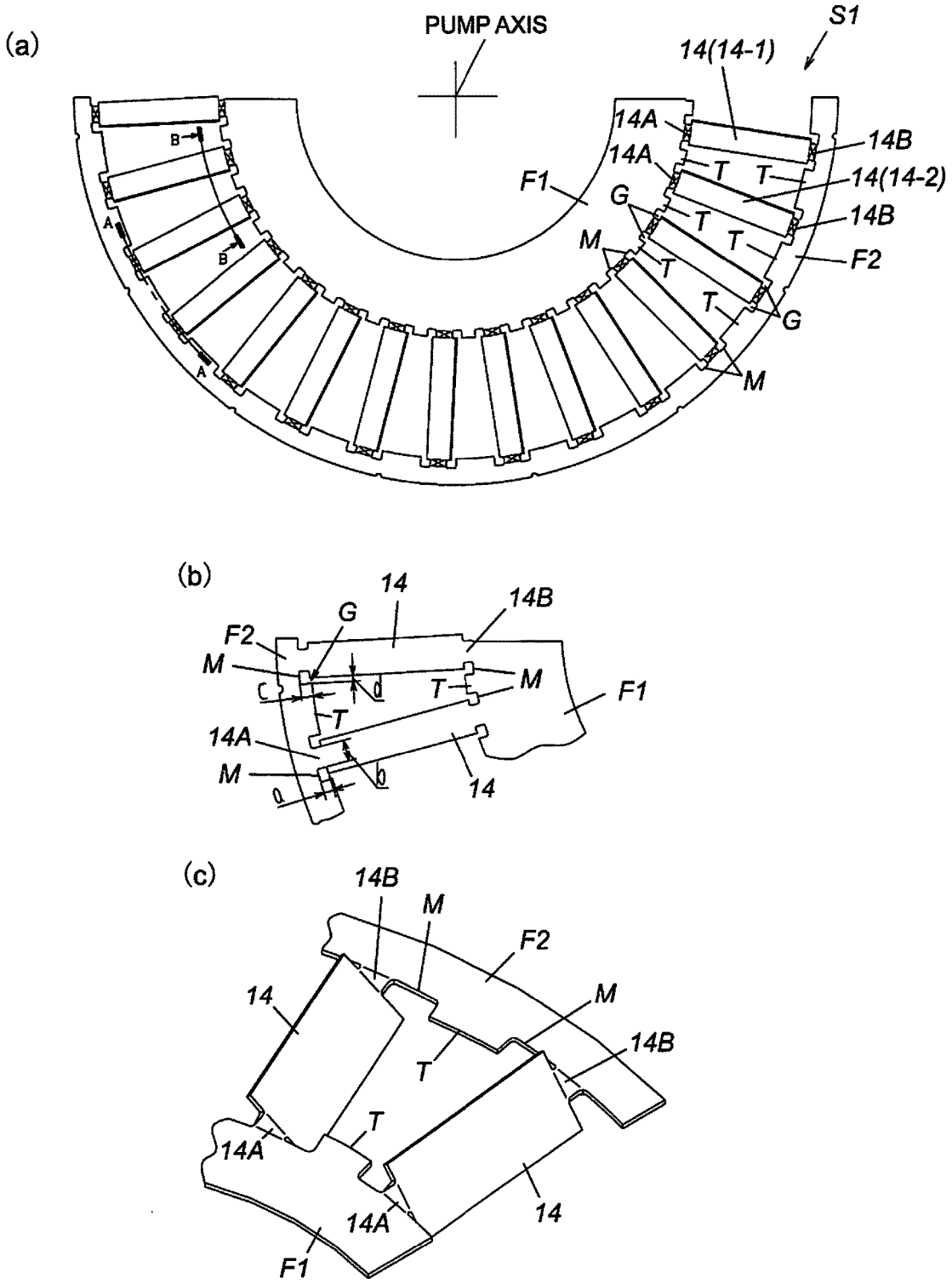

[FIG.3]
(a)
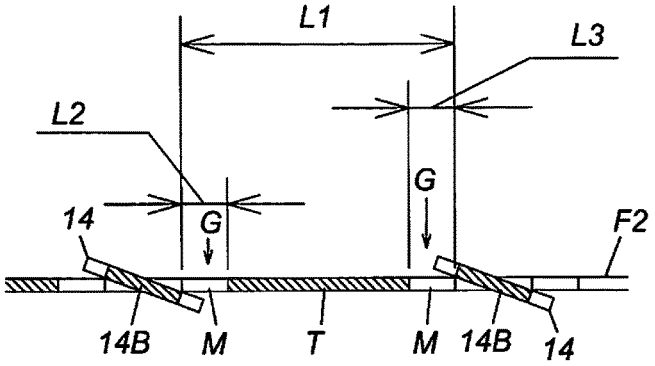
(b)
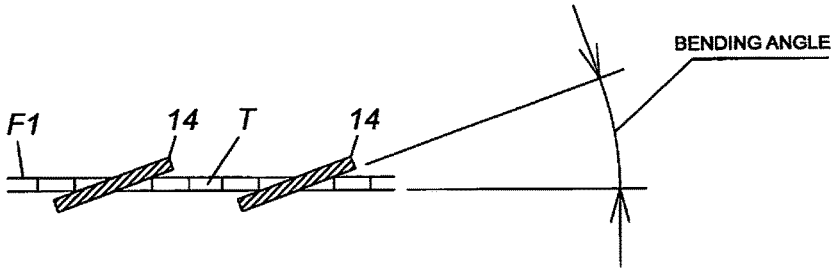

[FIG.4]
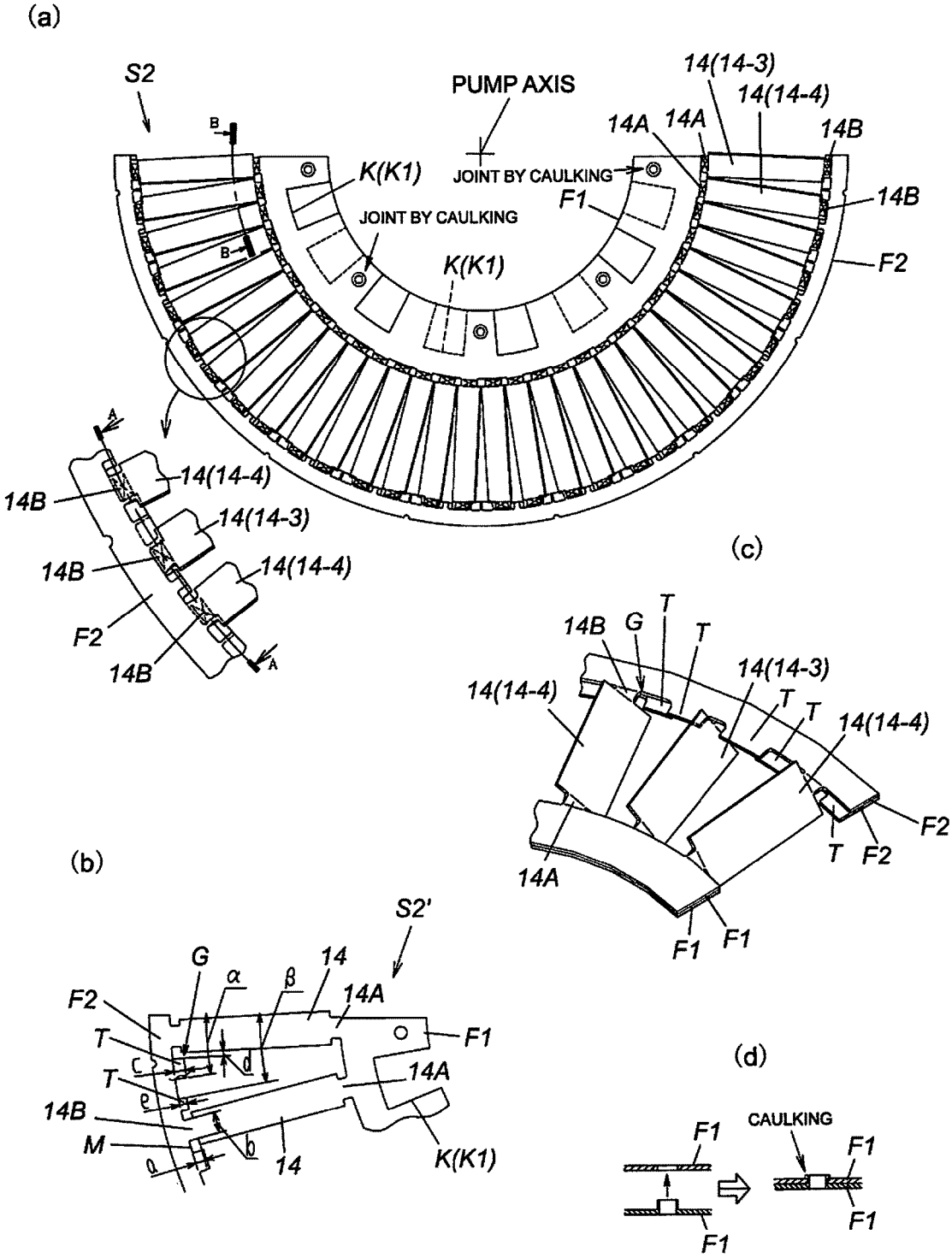

[FIG.5]
(a)
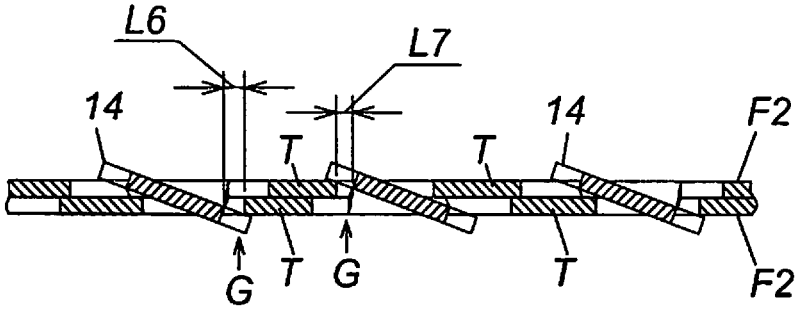
(A CASE IN WHICH PROJECTING PORTION IS PRESENT)
(b)
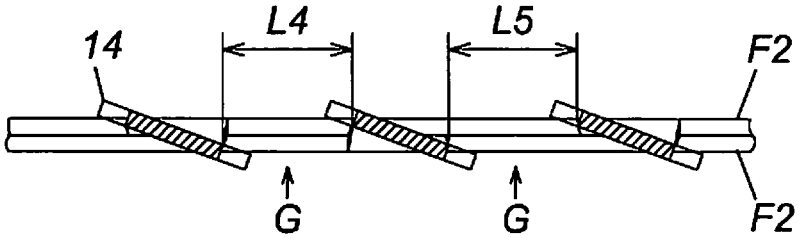
(A CASE IN WHICH PROJECTING PORTION IS ABSENT)

[FIG.6]
(a)
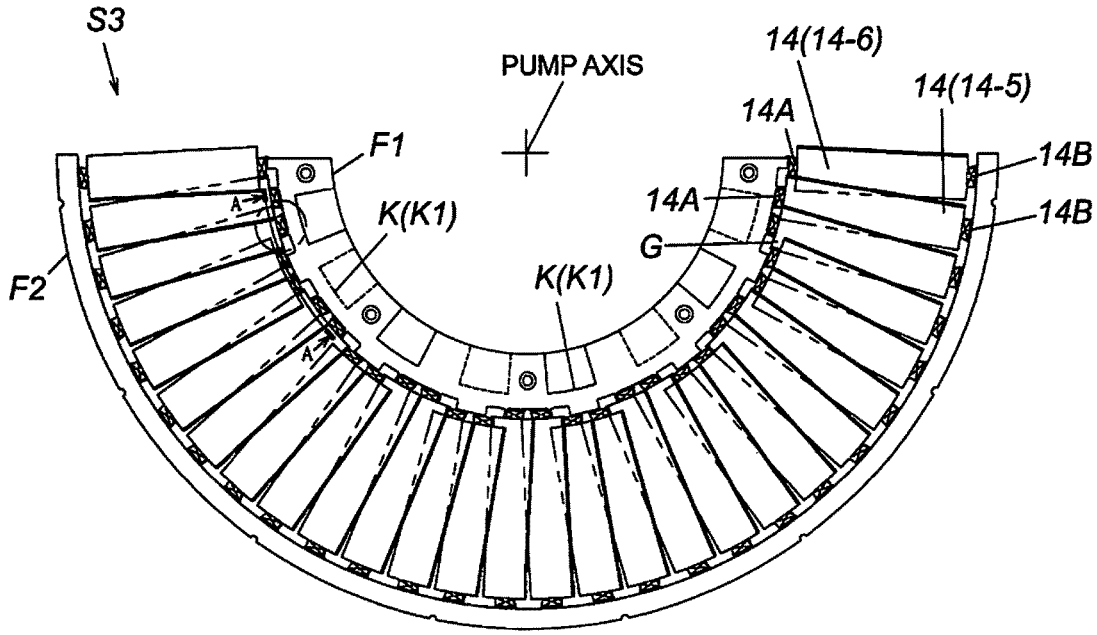
(b)
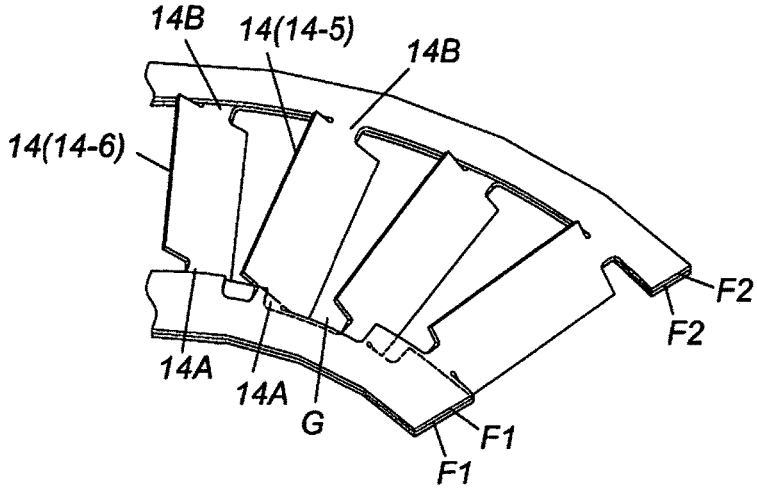

[FIG.7]
(a)
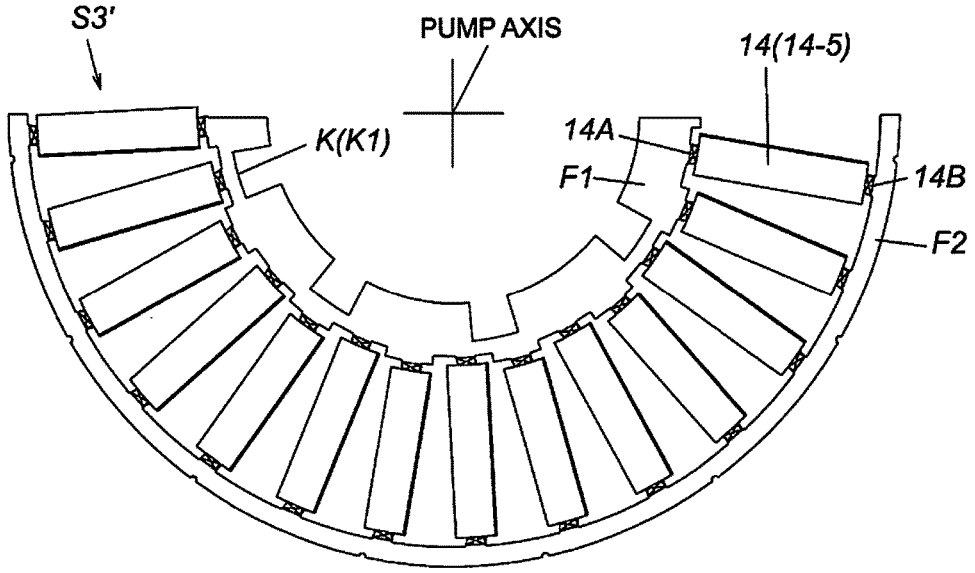
(b)
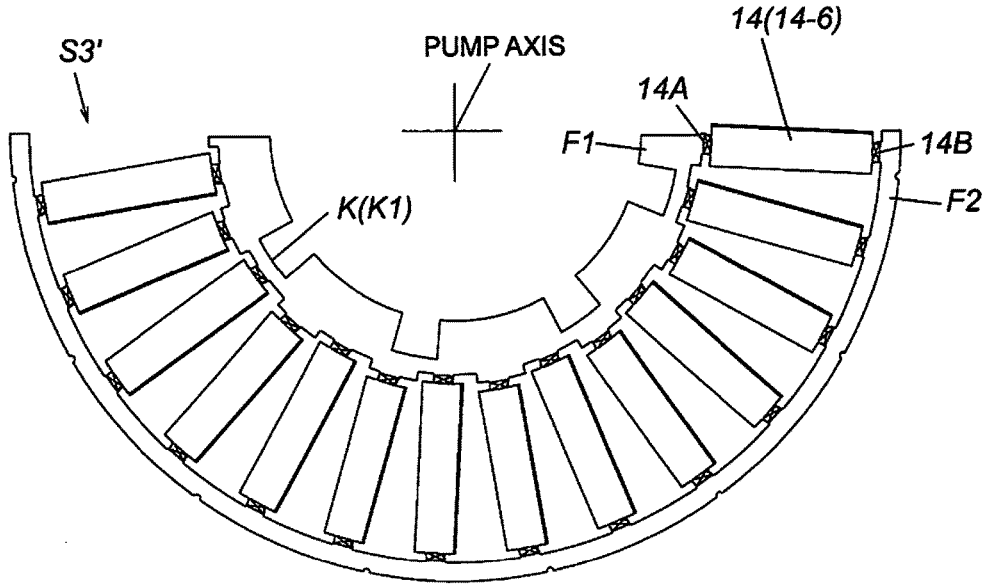

[FIG.8]
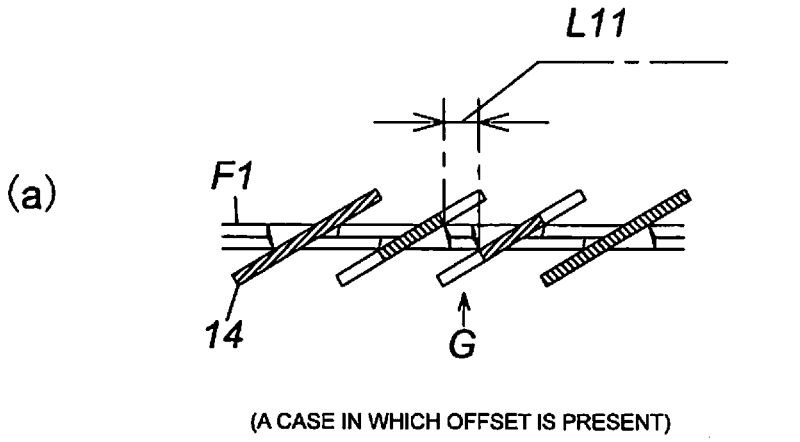

[FIG.9]
(a)
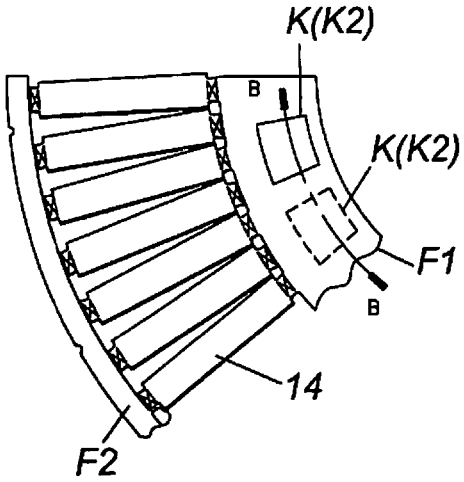
(b)
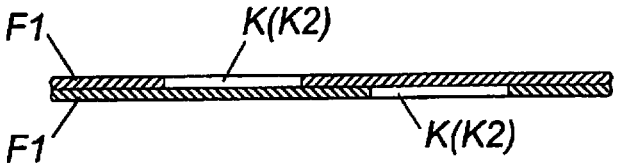
[FIG.10]
(a)
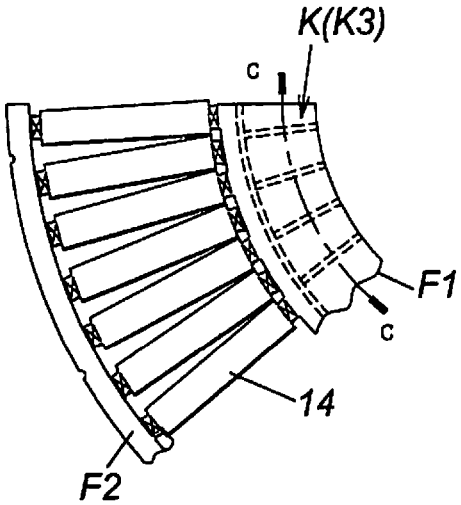
(b)
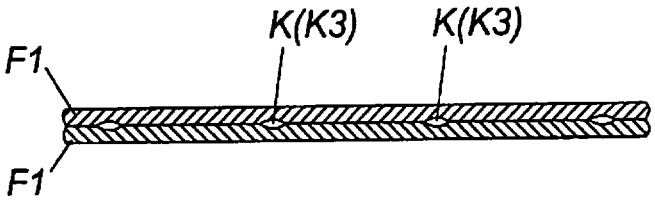

[FIG.11]
(a)
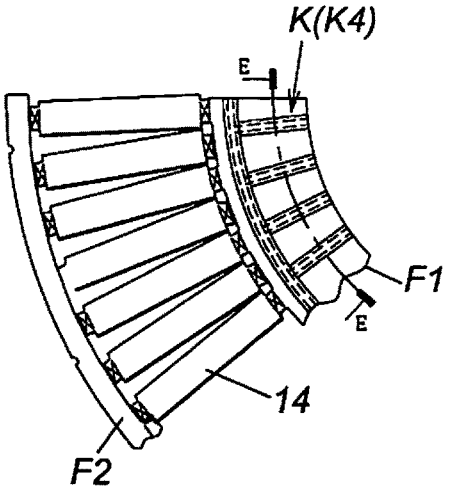
(b)
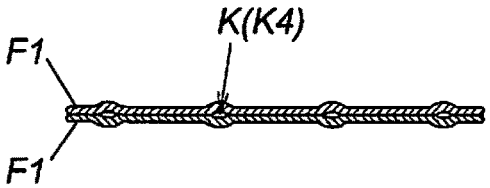
[FIG.12]
(a)
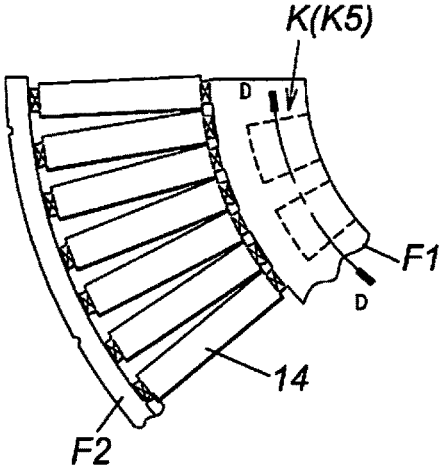
(b)
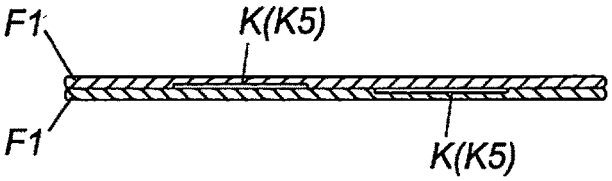

[FIG.13]
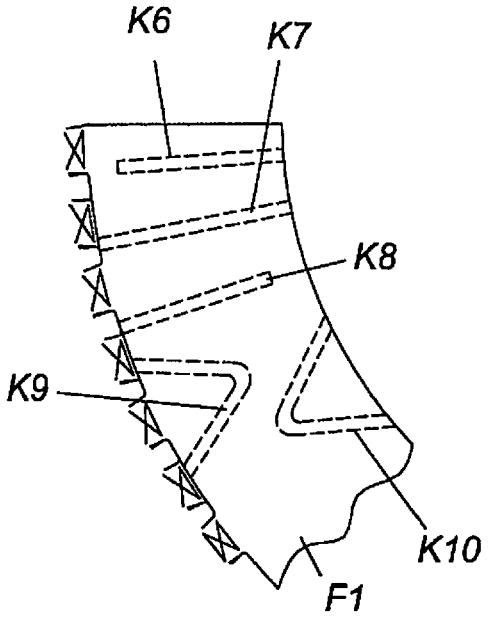

FIXED BLADE ASSEMBLY USABLE IN EXHAUST PUMP, AND EXHAUST PUMP PROVIDED WITH SAME

CROSS-REFERENCE TO RELATED APPLICATION

This Application is a Section 371 National Stage Application of International Application No. PCT/JP2011/070800, filed Sep. 13, 2011, which is incorporated by reference in its entirety and published as WO 2012/081287 on Jun. 21, 2012, not in English, and which claims priority to Japanese Patent Application 2010-278153 filed on Dec. 14, 2010.

BACKGROUND

The present invention relates to a stator blade assembly usable in an exhaust pump suitable as gas evacuation means of a process chamber or other sealed chambers of a semiconductor production device, a flat panel display production device, and a solar panel production device, and also relates to an exhaust pump provided with such a stator blade assembly. More particularly, the present invention is aimed at the improvement of evacuation performance by shortening an evacuation time of the exhaust pump.

A vacuum pump described, for example, in Japanese Patent Application Publication No. 2003-269365 is known as an exhaust pump of this kind. As shown in FIG. 13 of Japanese Patent Application Publication No. 2003-269365, the vacuum pump described in Japanese Patent Application Publication No. 2003-269365 has a structure in which a plurality of rotor blades (9) protruding from an outer circumferential surface of a rotatable rotor (2) and a plurality of stator blades (10) protruding toward the outer circumferential surface of the rotatable rotor (2) are arranged alternately in multiple stages along an axis of the rotor (2).

Referring to FIGS. 3 and 4 of Japanese Patent Application Publication No. 2003-269365, a plurality of stator blades (10) positioned in any one stage, from among the aforementioned stages, have a structure in which inner and outer blade bases are supported by frames (10-1, 10-2) for each stage.

However, in the vacuum pump described in Japanese Patent Application Publication No. 2003-269365 presented hereinabove by way of example, slits (102-2, 102-3) are formed by cutting in the vicinity of a blade base in order to incline the stator blade (10) at a predetermined angle, as shown in FIG. 1 of Japanese Patent Application Publication No. 2003-269365, and the stator blade (10) is bent. The resultant problem is that a gap unavoidably appears in the vicinity of the blade base of the stator blade (10) due to the slits (102-2, 102-3), which are necessary to perform such bending, and gas molecules flow in reverse (internal leak) through this gap, thereby increasing the time required to reach the desired degree of vacuum after the evacuation is started (referred to hereinbelow as "evacuation time").

Referring to FIG. 4B of Japanese Patent Publication No. 4517724, in a vacuum pump described in Japanese Patent Publication No. 4517724, one stator blade (21(A)) and a stator blade (21(C)) transversely adjacent thereto are formed as a stator blade assembly of a double-layer stacked structure by supporting the respective blade bases with separate frames (23) (see FIG. 4A of Japanese Patent Publication No. 4517724) and superimposing those frames (23) in the vertical direction, this assembly representing a specific configuration of a plurality of stator blades (21) positioned in each stage that has been explained hereinabove.

However, in the stator blade assembly of a double-layer stacked structure such as described in Japanese Patent Publication No. 4517724, the frames (23) superimposed in the vertical direction can be opened in the vertical direction due to warping or bending. A problem caused by such opening of the frames (23) is that the height of the stator blades (23) becomes uneven and the decrease in evacuation efficiency caused by such unevenness increases the evacuation time.

Another problem associated with the stator blade assembly of a double-layer stacked structure such as described in Japanese Patent Publication No. 4517724 is that since the frames (23) are superimposed in the vertical direction, gas or fluid can be confined between the vertically superimposed frames (23), the gas or fluid, which has thus been confined, continuously and gradually flows out during the evacuation operation from the portion where the frames (23) are superimposed, thereby also extending the evacuation time.

The discussion above is merely provided for general background information and is not intended to be used as an aid in determining the scope of the claimed subject matter. The claimed subject matter is not limited to implementations that solve any or all disadvantages noted in the background.

SUMMARY

Embodiments have been created to resolve the above-described problems and it is an object of the present invention to provide a stator blade assembly advantageously improving the evacuation performance by shortening the evacuation time, and an exhaust pump provided with such a stator blade assembly.

In order to attain the aforementioned object, the first aspect provides a stator blade assembly which is usable in an exhaust pump in which a plurality of rotor blades protruding from an outer circumferential surface of a rotatable rotor and a plurality of stator blades protruding toward the outer circumferential surface of the rotor are alternately disposed in multiple stages along an axis of the rotor, wherein the plurality of stator blades are configured such that inner and outer stator blade bases are supported by frames, and a projecting portion protruding from the frame supporting the inner stator blade base, or from the frame supporting the outer stator blade base, or from both of the frames is provided in a gap in the vicinity of the outer or inner stator blade base between one of the supported stator blades and a stator blade transversely adjacent thereto.

In the first aspect, the inner and outer stator blade bases of the one stator blade and the inner and outer stator blade bases of the stator blade transversely adjacent thereto may be configured as a stator blade assembly of a single-layer structure by being supported by the same frame.

In the first aspect, the inner and outer stator blade bases of the one stator blade and the inner and outer stator blade bases of the stator blade transversely adjacent thereto are supported by separate frames, and the stator blade assembly is formed as a double-layer stacked structure by superimposing and joining those frames in a vertical direction, and the projecting portion overlaps the gap in the vicinity of the outer or inner stator blade base.

The second aspect provides a stator blade assembly which is usable in an exhaust pump in which a plurality of rotor blades protruding from an outer circumferential surface of a rotatable rotor and a plurality of stator blades protruding toward the outer circumferential surface of the rotor are alternately disposed in multiple stages along an axis of the rotor, wherein any one of the plurality of stator blades and a stator blade transversely adjacent thereto are configured to be formed as a single-layer stator blade assembly by supporting respective stator blade bases with separate frames, and by superimposing and joining those frames in a vertical direction, and also configured such that a stator blade end portion in the vicinity of the one stator blade base overlaps a gap in the vicinity of the stator blade base transversely adjacent thereto by displacing the respective stator blade bases with respect to each other in a diametrical direction of the rotor.

The third aspect provides a stator blade assembly which is usable in an exhaust pump in which a plurality of rotor blades protruding from an outer circumferential surface of a rotatable rotor and a plurality of stator blades protruding toward the outer circumferential surface of the rotor are alternately disposed in multiple stages along an axis of the rotor, wherein any one of the plurality of stator blades and a stator blade transversely adjacent thereto are configured to be formed as a single-layer stator blade assembly by supporting respective stator blade bases with separate frames, superimposing those frames in a vertical direction, and joining together the frames that support the outer or inner stator blade bases.

In the third aspect, the configuration can be used in which a superposition portion of the frames is provided with release means for releasing a gas or fluid confined in the superposition portion to the outside of the frames.

In the third aspect, the release means is constituted by a notch formed in the frame.

In the third aspect, the release means is constituted by a hole formed in the frame.

In the third aspect, the release means is constituted by a release slit formed in the frame.

In the third aspect, the release means is constituted by a recess formed in the frame.

In the third aspect, the joining between the frames may be performed by caulking.

The exhaust pump in accordance with several of the embodiments is provided with any of the stator blade assemblies according to the first to third aspects.

According to the first aspect, the configuration, in which the inner and outer stator blade bases of the plurality of stator blades are supported by the frames, and the projecting portion protruding from the frame supporting the inner stator blade base, or from the frame supporting the outer stator blade base, or from both of the frames is provided in the gap in the vicinity of the outer or inner stator blade base between one of the supported stator blades and a stator blade transversely adjacent thereto, is used as the specific configuration of a stator blade assembly usable in an exhaust pump. Therefore, the reverse flow (internal leak) of gas molecules through the gap in the vicinity of such stator blade bases is inhibited by the aforementioned projecting portion. As a consequence, evacuation can be performed at a high rate and the evacuation time can be shortened.

According to the second aspect, the configuration in which any one of the plurality of stator blades and a stator blade transversely adjacent thereto are formed as a single-layer stator blade assembly by supporting respective stator blade bases with separate frames, and by superimposing and joining those frames in a vertical direction, and the configuration in which a stator blade end portion in the vicinity of the one stator blade base overlaps a gap in the vicinity of the stator blade base transversely adjacent thereto by displacing the respective stator blade bases with respect to each other in a diametrical direction of the rotor, are used as the specific configurations of a stator blade assembly usable in an exhaust pump. Therefore, according to the second aspect of the invention, the reverse flow of gas molecules through the gap is inhibited by the stator blade end portion located in the vicinity of the blade base and overlapping the gap. As a consequence, evacuation can be performed at a high rate and the evacuation time can be shortened.

According to the third aspect, the configuration, in which any one of the plurality of stator blades and a stator blade transversely adjacent thereto are formed as a single-layer stator blade assembly by supporting respective stator blade bases with separate frames, superimposing those frames in a vertical direction, and joining together the frames that support the outer or inner stator blade bases, is used as the specific configuration of a stator blade assembly usable in an exhaust pump. Therefore, the frames superimposed in the vertical direction are prevented from being opened in the vertical direction due to warping or bending in the vicinity of the outer or inner stator blade base, and the height unevenness of the stator blades caused by such an opening and the degradation of evacuation performance caused by such unevenness can be effectively prevented, thereby making it possible to shorten the evacuation time.

In particular, according to the third aspect, when a configuration is used that is provided with release means for releasing a gas or fluid confined in a superposition portion of the frames to the outside of the frames, the gas or fluid confined in the superposition portion of the frames is rapidly released to the outside by the release means. As a result, such gas or fluid is prevented from continuously and gradually flowing out from the superposition portion of the frames and, therefore, the evacuation time can be further shortened.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIG. 1 is a cross-sectional view of an exhaust pump using the present invention;

FIG. 2A is a plan view of a stator blade assembly of a single-layer structure; FIG. 2B is a plan view illustrating a state before a plurality of stator blades is bent in the stator blade assembly of a single-layer structure; and FIG. 2C is a partial perspective image of the stator blade assembly of a single-layer structure;

FIG. 3A is a spread enlarged view taken along a cross section AA in FIG. 2A; and FIG. 3B is a spread enlarged view taken along a cross section BB in FIG. 2A;

FIG. 4A is a plan view of a stator blade assembly of a double-layer stacked structure; FIG. 4B is a plan view illustrating a state before a plurality of stator blades is bent in the stator blade assembly of a double-layer stacked structure; FIG. 4C is a partial perspective image of the stator blade assembly of a double-layer stacked structure; and FIG. 4D is an explanatory drawing illustrating the caulking process;

FIG. 5A is a spread enlarged view taken along a cross section AA of the stator blade assembly provided with a projecting portion shown in FIG. 4A; and FIG. 5B is a spread enlarged view taken along a cross section AA and relating to the case in which the projecting portion shown in FIG. 4A is not present;

FIG. 6A is a plan view of a stator blade assembly of a double-layer stacked structure that uses the structural example preventing the internal leak (reverse flow of gas molecules through the gap) by a configuration in which the stator blades are displaced (offset) in the diametrical direction of the rotor; and FIG. 6B is a partial perspective image view of this stator blade assembly;

FIGS. 7A and 7B are plan views of a part (state after the plurality of stator blades 14 have been bent) prior to superposition in the stator blade assembly of a double-layer stacked structure shown in FIG. 6A;

FIG. 8A is a spread enlarged view taken along the cross section AA of the stator blade assembly in which the stator blades are displaced (offset) with respect to each other in the diametrical direction of the rotor, as shown in FIG. 6A; and FIG. 8B is a spread enlarged view taken along the cross section AA and relating to the case in which such offset has not been made;

FIG. 9A is an explanatory drawing illustrating another specific structural example of the release means; and FIG. 9B is a spread enlarged view taken along the cross section BB in FIG. 9A;

FIG. 10A is an explanatory drawing illustrating another specific structural example of the release means; and FIG. 10B is a spread enlarged view taken along the cross section CC in FIG. 10A;

FIG. 11A is an explanatory drawing illustrating another specific structural example of the release means; and FIG. 11B is a spread enlarged view taken along the cross section EE in FIG. 11A;

FIG. 12A is an explanatory drawing illustrating another specific structural example of the release means; and FIG. 12B is a spread enlarged view taken along the cross section DD in FIG. 12A; and FIG. 13 is an explanatory drawing illustrating another specific structural example of the release means.

DETAILED DESCRIPTION

FIG. 1 is a cross-sectional view of an exhaust pump using the present invention. The exhaust pump P shown in the figure is suitable as gas evacuation means of a process chamber or other sealed chambers of a semiconductor production device, a flat panel display production device, and a solar panel production device. The exhaust pump P has a blade evacuation portion Pt that discharges gas by a rotor blade 13 and a stator blade 14, a screw slit evacuation portion Ps that discharges gas by using a screw slit 19, and a drive system therefor inside an outer case 1.

The outer case 1 has a bottomed cylindrical shape obtained by integrally connecting a tubular pump case 1A and a bottomed tubular pump base 1B with bolts in the axial direction thereof. An upper end side of the pump case 1A is opened as a gas intake port 2, and a gas evacuation port 3 is provided in a lower end side surface of the pump base 1B.

The gas intake port 2 is connected to a sealed chamber (not shown in the figure), which is under a high vacuum, for example, such as a process chamber of a semiconductor production device, by a bolt (not shown in the figure) provided in a flange 1C on an upper edge of the pump case 1A. The gas evacuation port 3 is connected so as to communicate with an auxiliary pump (not shown in the figure).

A cylindrical stator column 4 incorporating various electrical components is provided in a central portion inside the pump case 1A, and the stator column 4 is provided in a vertical condition in a state such that a lower end side thereof is fixed by screws to the pump base 1B.

A rotor shaft 5 is provided on the inside of the stator column 4. The rotor shaft 5 is disposed such that the upper end thereof faces in the direction of the gas intake port 2 and the lower end thereof faces in the direction of the pump base 1B. Further, the upper end of the rotor shaft 5 is provided so as to protrude upward from the cylindrical upper end surface of the stator column 4.

The rotor shaft 5 is float supported to be rotatable in the diametrical direction and axial direction by magnetic forces of a radial magnetic bearing 10 and an axial magnetic bearing 11 and can be rotationally driven by a drive motor 12. Further, protective bearings B1, B2 are provided at upper and lower end sides of the rotor shaft 5.

A rotor 6 is provided on the outside of the stator column 4. The rotor 6 has a cylindrical shape surrounding the outer circumference of the stator column 4 and is integrated with the rotor shaft 5. Therefore, in the exhaust pump P shown in FIG. 1, the rotor shaft 5, radial magnetic bearings 10 and axial magnetic bearing 11 function as support means for supporting the rotor 6 so that the rotor can rotate about the axis thereof. Further, since the rotor 6 rotates integrally with the rotor shaft 5, the drive motor 12 that rotationally drives the rotor shaft 5 functions as drive means for rotationally driving the rotor 6.

The detailed configurations of the drive motor 12, protective bearings B1 and B2, radial magnetic bearing 10, and axial magnetic bearing 11 are the contents well known in the related art and, therefore, the explanation thereof is herein omitted.

Detailed Configuration of Blade Evacuation Portion Pt

In the exhaust pump P shown in FIG. 1, a zone upstream of a substantially central portion of the rotor 6 (a range from a substantially central portion of the rotor 6 to the end of the rotor 6 on the gas intake port 2 side) functions as a blade evacuation portion Pt. The blade evacuation portion Pt will be described below in greater detail.

A plurality of rotor blades 13 is integrally provided on the outer circumferential surface of the rotor 6 on the upstream side from the substantially central portion of the rotor 6. The plurality of rotor blades 13 protrudes from the outer circumferential surface of the rotor 6 in the diametrical direction of the rotor and is disposed radially, with an axial rotation center (rotor shaft 5) of the rotor 6 or an axis of the outer case 1 (referred to hereinbelow as "pump axis") as a center. The rotor blades 13 are machined parts formed by cutting integrally with the outer radially machined portions of the rotor 6 and are inclined at an angle optimum for discharging gas molecules.

A plurality of stator blades 14 is provided on the inner circumferential surface side of the pump case 1A. The stator blades 14 protrude from the inner circumferential surface of the pumps case 1A toward the outer circumferential surface of the rotor 6 and are disposed radially, with the pump axis as a center (see FIGS. 2 and 4). Similarly to the rotor blades 13, the stator blades 14 are also inclined at an angle optimum for discharging gas molecules.

In the exhaust pump P shown in FIG. 1, the plurality of rotor blades 13 and stator blades 14, such as described hereinabove, are alternately disposed in a large number of stages along the pump axis, thereby forming the multistage blade evacuation portion Pt.

In the multistage blade evacuation portion Pt, the plurality of stator blades 14 positioned in at least one stage is formed as a stator blade assembly S1 of a single-layer structure shown in FIG. 2, for each stage thereof. Alternatively, the plurality of stator blades 14 positioned in at least one stage is formed as a stator blade assembly S2 of a double-layer stacked structure shown in FIG. 4, for each stage thereof. In another possible configuration, the plurality of stator blades 14 positioned in at least one stage is formed as a stator blade assembly S1 of a single-layer structure, and the plurality of stator blades 14 positioned in another at least one stage is formed as a stator blade assembly S2 of a double-layer stacked structure. The detailed configuration of the stator blade assemblies S1, S2 is explained below.

Detailed Configuration of Stator Blade Assembly S1 of Single-Layer Structure Referring to FIG. 2A, the stator blade assembly S1 of a single-layer structure is provided with a plurality of stator blades 14 arranged radially, as explained hereinabove, with a pump axis as a center, and frames F1, F2 supporting inner and outer stator blade bases 14A, 14B of those stator blades 14. In the stator blade assembly S1 of a single-layer structure, for example, one stator blade 14 (14-1) and a stator blade 14 (14-2) transversely adjacent thereto have a structure such that the inner and outer stator blade bases 14A, 14B thereof are supported by the same frame F1, F2, respectively.

As follows from the description of the aforementioned support structure, in a plurality of stator blades 14 positioned in at least one stage of the multistage blade evacuation portion Pt, the inner and outer stator blade bases 14A, 14B are supported by the frames F1, F2 for each stage. Further, a projecting portion T protruding from the frame F2 supporting the outer stator blade base 14B and a projecting portion T protruding from the frame F1 supporting the inner stator blade base 14A are provided in a gap in the vicinity of the inner and outer stator blade bases 14A, 14B between one of the supported stator blades 14 (for example, 14-1) and the stator blade 14 (for example, 14-2) transversely adjacent thereto. If necessary, one of those projecting portions T may be omitted.

The projecting portions T function as means for preventing the reverse flow (internal leak) of gas molecules through a gap G in the vicinity of the stator blade bases 14A, 14B.

Thus, in the exhaust pump P shown in FIG. 1, a slit M is formed by cutting in the vicinity of the stator blades 14A, 14B and the stator blades 14 are bent in order to incline the stator blades 14 at a predetermined angle, as explained hereinabove. The aforementioned gap G in the vicinity of the stator blade bases 14A, 14B is produced by this slit M (referred to hereinbelow as "bending slit M"), which is necessary for such bending of the blades. In the exhaust pump P shown in FIG. 1, since the projecting portion T is disposed in such gap G, the reverse flow (internal leak) of gas molecules through the gap G is reduced, the evacuation rate is increased, and the evacuation time is shortened.

FIG. 2B is a plan view illustrating a state before the plurality of stator blades is bent in the stator blade assembly S1 of a single-layer structure.

In FIG. 2B, the reference symbol "a" denotes a width of the bending slit M, the reference symbol "b" denotes a width of the stator blade base 14A that is reduced by the formation of the bending slit M, the reference symbol "c" denotes a protrusion amount of the projecting portion T, and the reference symbol "d" denotes a width of the gap G between the projecting portion T and the stator blade 14.

The widths "a" and "b" are determined by conditions such as the material, thickness, and inclination (bending) angle (see FIG. 3B) of the stator blade 14. The protrusion amount "c" can be changed, as necessary. In particular, when the condition of "c" being equal to "a" or being greater than "a" ($c \geq a$) is fulfilled, the aforementioned reverse flow (internal leak) reduction effect is improved. The width "d" differs depending on means (wire machining, laser machining, or pressing) for forming the stator blade assembly S1, but from the standpoint of reducing the reverse flow of gas molecules, it is preferred that this width be set as small as possible.

FIG. 3A is a spread enlarged view taken along a cross section AA in FIG. 2A. In FIG. 3A, the reference symbol L1 denotes a width of the gap in the vicinity of the bending slit in a case in which the projecting portion T is not present, and reference symbols L2 and L3 denote widths of the gap G in the vicinity of the bending slit M that have been reduced by the formation of the projecting portion T. Comparing the cases in which the projecting portion T is present and absent, the width of the gap G in the case in which the projecting portion T is present is reduced to equal to or less than 30% ($(L2+L3)/L1*100<30\%$). Therefore, in the same example, the effect of reducing the reverse flow (internal leak) of gas molecules through the gap G by equal to or more than 70% is obtained.

Detailed Configuration of Stator Blade Assembly S2 of Double-Layer Stacked Structure Referring to FIG. 4A, the stator blade assembly S2 of a double-layer stacked structure is also provided with a plurality of stator blades 14 arranged radially, as explained hereinabove, with a pump axis as a center, and frames F1, F2 supporting the inner and outer stator blade bases 14A, 14B of those stator blades 14.

In the stator blade assembly S2 of a double-layer stacked structure, for example, one stator blade 14 (14-3) and a stator blade 14 (14-4) transversely adjacent thereto have a structure such that the inner stator blade bases 14A are supported by separate frames F1, and those frames F1 are superimposed and joined in the vertical direction, as shown in FIG. 4C. The outer stator blade bases 14B are also supported by separate frames F2, and those frames F2 are superimposed and joined in the vertical direction.

In the example shown in FIG. 4A, a configuration in which the frames F1 supporting the respective inner stator blade bases 14A are joined by caulking such as illustrated by FIG. 4D is used as a specific structural example of how the frames F1, F2 are joined.

With the exhaust pump P using the aforementioned joining configuration, the phenomenon of the frames F1 superimposed in the vertical direction being opened in the vertical direction due to warping or bending can be inhibited, and the height unevenness of the stator blades caused by such a phenomenon and the degradation of evacuation performance caused by such unevenness can be effectively prevented. In order to inhibit this phenomenon more effectively, it is preferred that the caulked portion be provided in the vicinity of the inner end of the frame F1, as shown in FIG. 4A.

A method for joining the aforementioned frames F1 together is not limited to caulking such as illustrated by FIG. 4D and explained hereinabove. For example, a method other than caulking, such as bonding with an adhesive or welding, can be also used.

As follows from the description of the support structure, in the plurality of stator blades positioned in at least one stage in the multistage blade evacuation portion Pt, the inner and outer stator blade bases 14A, 14B are supported by the frames F1, F2 for each stage. Further, the projecting portion T protruding from the frame F2 supporting the outer stator blade base 14B is provided, as shown in FIG. 4C, between one of the supported stator blades 14 (for example, 14-3) and the stator blade 14 (for example, 14-4) transversely adjacent thereto.

Since the projecting portion T is formed to overlap the gap G in the vicinity of the stator blade base 14B, the projecting portion functions as means for preventing the reverse flow (internal leak) of gas molecules through the gap G. Such a projecting portion T may be formed to protrude from the frame F1 supporting the inner stator blade base 14A and can be also formed to protrude from the two frames F1, F2 (such configurations are not shown in the figure).

FIG. 4B is a plan view illustrating a part S2' (a state before the plurality of stator blades 14 is bent) in the stator blade assembly S2 of a double-layer stacked structure shown in FIG. 4A prior to overlapping. The stator blade assembly S2 of a double-layer stacked structure shown in FIG. 4A is obtained by producing two parts S2' (two identical parts) shown in FIG. 4B, turning one part over, and superimposing on the other part.

In FIG. 4B, the reference symbol "a" denotes a width of the bending slit M, the reference symbol "b" denotes a width of the stator blade base 14B that is reduced by the formation of the bending slit M, the reference symbols "c" and "e" denote protrusion amounts of the projecting portion T, and the reference symbol "d" denotes a width of the gap G (gap in the vicinity of the stator blade base 14B) between the projecting portion T and the stator blade 14.

The widths "a" and "b" are determined by conditions such as the material, thickness, and inclination (bending) angle (see FIG. 3B) of the stator blade 14. The protrusion amount "c" can be changed, as necessary. In particular, when the condition of "c" being equal to "a" or being greater than "a" ($c \geq a$) is fulfilled, the aforementioned reverse flow (internal leak) reduction effect is improved. The width "d" differs depending on means (wire machining, laser machining, or pressing) for forming the part S2', but from the standpoint of reducing the reverse flow of gas molecules after the parts S2' have been obtained by superposition and joining, it is preferred that the width "d" be set as small as possible.

Further, the protrusion amount "e" is set less than the width "a" ($e<a$). This is done so as to avoid interference between the projecting portion T with the size "e" and the distal end portion of the stator blade 14 that can occur because the distal end portion of the bent stator blade 14 is disposed at the projecting portion T with the size "e". Angles $\alpha$ and $\beta$ are also set such as to prevent the interference.

FIG. 5A is a spread enlarged view taken along a cross section AA of the stator blade assembly S2 provided with the projecting portion T such as shown in FIG. 4A, and FIG. 5B is a spread enlarged view taken along the cross section AA and relating to the case in which the projecting portion T shown in FIG. 4A is not present (comparative example relating to FIG. 5A).

In FIGS. 5A and 5B, the reference symbols L4 and L5 denote a width of the gap G in the vicinity of the bending slit M in a case in which the projecting portion T is not present, and reference symbols L6 and L7 denote the width of the gap G in the vicinity of the bending slit M that has been reduced by the formation of the projecting portion T. Comparing the cases in which the projecting portion T is present and absent, the width of the gap G in the case in which the projecting portion T is present is reduced to equal to or less than 10% $((L6+L7)/(L4+L5)*100<10\%)$. Therefore, in the same example, the effect of reducing the reverse flow (internal leak) of gas molecules through the gap G in the vicinity of the bending slit M by equal to or more than 90% is obtained.

FIG. 6A is a plan view of a stator blade assembly S3 of a double-layer stacked structure that uses the structural example preventing the internal leak (reverse flow of gas molecules through the gap) by a configuration in which the stator blades are displaced (offset) in the diametrical direction of the rotor. FIG. 6B is a partial perspective image view of this stator blade assembly. Further, FIGS. 7A and 7B are plan views of a part S3' (state after the plurality of stator blades 14 have been bent) prior to superposition in the stator blade assembly S3 of a double-layer stacked structure shown in FIG. 6.

The part S3' shown in FIG. 7B is obtained by turning over the part S3' shown in FIG. 7A, and the stator blade assembly S3 of a double-layer stacked structure shown in FIGS. 6A and 6B is obtained by superimposing and joining the parts S3' shown in FIGS. 7A and 7B.

In the stator blade assembly S3 of a double-layer stacked structure shown in FIGS. 6A and 6B, for example, the one stator blade 14 (14-5) and the stator blade 14 (14-6) transversely adjacent thereto, from among the plurality of stator blades 14 constituting the assembly, have a structure such that the stator blade bases 14A, 14B are supported by separate frames F1, F2, respectively, and those frames F1, F2 are superimposed in the vertical direction and joined, as shown in FIGS. 7A and 7B.

In FIGS. 6A and 6B, for example, one stator blade 14 (14-5) and the stator blade 14 (14-6) transversely adjacent thereto are configured such that the inner stator blade bases 14A thereof are displaced (offset) with respect to each other in the diametrical direction of the rotor 6. As a result, the stator blade end portion in the vicinity of the inner stator blade base 14A of one stator blade 14 (14-5) overlaps the gap G in the vicinity of the inner stator blade base 14A of the stator blade 14 (14-6) transversely adjacent thereto.

Therefore, the reverse flow of gas molecules through the gap G is inhibited by the stator blade end portion in the vicinity of the inner stator blade base 14A of one stator blade 14 (14-5). As a consequence, in the exhaust pump P using the stator blade assembly S3 of a double-layer stacked structure shown in FIGS. 6A and 6B, the evacuation rate is also increased and the evacuation performance is also improved due to the shortened evacuation time.

In FIGS. 6A and 6B, a structure is used in which the stator blade end portion in the vicinity of the inner stator blade base 14A of the one stator blade 14 (14-5) overlaps the gap G in the vicinity of the inner stator blade base 14A of the stator blade 14 (14-6) adjacent thereto in order to shorten the evacuation time by reducing the gap G in the vicinity of the inner stator blade base 14A of the stator blade 14 (14-6) and preventing the reverse flow of gas molecules through this gap G. Such an overlapping structure can be also used in the vicinity of the outer stator blade base 14B of the stator blade 14. As a result, the gap in the vicinity of the outer stator blade base 14B of the stator blade 14 is also reduced and therefore, the evacuation rate is further increased and the evacuation time is further shortened, thereby improving the evacuation performance.

FIG. 8A is a spread enlarged view taken along the cross section AA of the stator blade assembly S3 in which the stator blades 14 are displaced (offset) with respect to each other in the diametrical direction of the rotor 6, as shown in FIGS. 6A and 6B, and FIG. 8B is a spread enlarged view taken along the cross section AA and relating to the case in which such offset has not been made (comparative example relating to FIG. 8A).

In FIGS. 8A and 8B, the reference symbols L8, L9, and L10 denote the width of the bending slit M in the case in which no offset is made, and the reference symbol L11 denotes the width of the gap in the vicinity of the bending slit M that has been narrowed by the offset. Comparing the case in which the offset is made and the case in which the offset is not made, the width of the gap G in the case in which the offset is made is reduced to equal to or less than 30% ((L11)/(L8+L9+L10)*100<30%). Therefore, in the same example, the effect of reducing the reverse flow (internal leak) of gas molecules through the gap by equal to or more than 70% is obtained.

In the stator blade assemblies S2 and S3 of a double-layer stacked structure shown in FIGS. 4A and 6A, release means K for releasing the gas or fluid confined in the superposition portion of the inner frame F1 is provided in the superposition portion of the inner frame F1.

In the example shown in FIGS. 4A and 6A, a notch K1 is formed in the inner edge of the inner frame F1 as a specific structural example of the release means K. Comparing the cases in which the notch K1 is provided and not provided, the contact surface area of the superposition surface of the frame F1 is less in the case in which the notch K1 is provided and, therefore, the amount of gas or fluid confined in the superposition portion of the frame F1 in this case is lower. In this example, in a portion where the notch K1 is not present, a certain amount of gas or fluid is also confined in the superposition portion of the frame F1, but the confined gas can rapidly flow to the outside of the frame F1 from the opening of the notch K1. As a result, with the exhaust pump P using the notch K1 such as that of the example illustrated by FIGS. 4A and 6A, the amount of gas or fluid that gradually and continuously flows out from the superposition portion of the frame F1 is reduced and, therefore, the evacuation time is shortened.

For example, a hole K2 formed in the inner frame F1 as shown in FIGS. 9A and 9B, a release slit K3 formed by cutting or pressing in the inner frame F1 as shown in FIGS. 10A and 10B, a release slit K4 formed by press bending in the inner frame F1 as shown in FIGS. 11A and 11B, a recess K5 formed by cutting or pressing in the inner frame F1 as shown in FIGS. 12A and 12B, or a combination of those notch K1, hole K2, release slits K3, K4, and recess K5 can be also used as other specific structural examples of the release means K.

In FIGS. 9A and 9B, a substantially quadrangular hole is shown as an example of the hole K2, but such shape of the hole is not limiting and holes of various shapes can be used. The same is true for the notch K1 shown in FIGS. 4A and 6A and the recess K5 shown in FIGS. 12A and 12B.

FIGS. 10A and 10B and FIGS. 11A and 11B show an example of the release slits K3, K4 in which the release slits K3, K4 are constituted by radial slits provided radially, with the pump axis as a center, and a communication slit that communicates with the radial slits, and one end of each radial slit is opened on the outside of the superposition portion of the frame F1, but such a configuration is not limiting. For example, release slits K6 to K10 of various shapes that are opened on the outside of the superposition portion of the frame F1, as shown in FIG. 13, can be also used.

Although not shown in the drawing, the above-described release means can be configured, as necessary, to be provided in the superposition portion of the outer frame F2 or both in the frame F1 and in the frame F2.

Explanation of Evacuation Operation Performed by Blade Evacuation Portion Pt

In the blade evacuation portion Pt of the above-described configuration, where the drive motor 12 is started, the rotor shaft 5, rotor 6, and a plurality of rotor blades 13 rotate integrally at a high speed, and the rotor blade 13 of the uppermost stage imparts a momentum in the downward direction to gas molecules introduced from the gas intake port 2. The gas molecules having such downward momentum are fed by the stator blade 14 to the rotor blade 13 of the next stage.

Gas molecules on the gas intake port 2 side are discharged so as to move successively toward the downstream zone of the rotor 6 by repeatedly performing the operations of imparting the above-described momentum to the gas molecules and feeding the gas molecules in multiple stages. In this case, the reverse flow (internal leak) of gas molecules through the gap G is prevented by the projecting portion T disposed so as to overlap the gap G in the vicinity of the end portion of the stator blade 14. Therefore, the evacuation rate is increased and the evacuation time can be shortened.

Detailed Configuration of Screw Slit Evacuation Portion Ps

The detailed configuration of the screw slit evacuation portion Ps is well known in the related art and the explanation thereof is herein omitted.

Explanation of Evacuation Operation in Screw Slit Evacuation Portion Ps

The gas molecules that have been transported by the evacuation operation of the blade evacuation portion Pt and have reached the blades (rotor blades in the example shown in FIG. 1) move from an upstream intake port of a screw slit evacuation passage S, which is opened theretoward, into the screw slit evacuation passage S. Those molecules are then moved toward the gas evacuation port 3, while being compressed from a transitional flow into a viscous flow, by the effect caused by the rotation of the rotor 6, that is, by the drag effect at the outer circumferential surface of the rotor 6 and in the screw slit 19, and eventually discharged to the outside through an auxiliary pump (not shown in the figure).

EXPLANATION OF REFERENCE NUMERALS

1 outer case
1A pump case
1B pump base
1C flange
2 gas intake port
3 gas evacuation port
4 stator column
5 rotor shaft
6 rotor
7 boss hole
9 shoulder portion
10 radial magnetic bearing
10A radial electromagnet target
10B X-axis electromagnet
10C X-axis eddy current gap sensor
11 axial magnetic bearing

11A armature disk
11B axial electromagnet
11C axial displacement sensor
12 drive motor
12A stator
12B rotor
13 rotor blade
14 stator blade
18 screw slit evacuation portion stator
19 screw slit
B1, B2 protective bearings
F1 frame supporting inner stator blade base of stator blade
F2 frame supporting outer stator blade base of stator blade
G gap in the vicinity of stator blade base
K release means
K1 notch (release means)
K2 hole (release means)
K3, K4 release slit (release means)
K5 recess (release means)
M bending slit
T projecting portion
P exhaust pump
Pt blade evacuation portion
Ps screw slit evacuation portion
S screw slit evacuation passage Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A stator blade assembly which has a double-layer stacked structure for an exhaust pump in which a plurality of rotor blades protruding from an outer circumferential surface of a rotatable rotor and a plurality of stator blades protruding toward the outer circumferential surface of the rotor are alternately disposed in multiple stages along an axis of the rotor, the stator blade assembly comprising:

a first frame supporting a first plurality of stator blades, each of the first plurality of stator blades having a stator blade end portion and a base extending from the stator blade end portion to the first frame;

a second frame supporting a second plurality of stator blades, each of the second plurality of stator blades having a stator blade end portion and a base extending from the stator blade end portion to the second frame;

wherein the first frame and the second frame are superimposed and joined in a direction along the axis of the rotor, such that the stator blade end portion of one of the first plurality of stator blades covers a gap of the base of one of the second plurality of stator blades that is transversely adjacent to the stator blade of the first plurality of stator blades, and wherein the base of the stator blade of the first plurality of stator blades is displaced with respect to the base of the transversely adjacent stator blade of the second plurality of stator blades in a diametrical direction of the rotor.

2. An exhaust pump comprising the stator blade assembly according to claim 1.

3. A stator blade assembly which has a double-layer stacked structure for an exhaust pump in which a plurality of rotor blades protruding from an outer circumferential surface of a rotatable rotor and a plurality of stator blades protruding toward the outer circumferential surface of the rotor are alternately disposed in multiple stages along an axis of the rotor, the stator blade assembly comprising:

a first frame supporting a first plurality of stator blades, each stator blade in the first plurality of stator blades having a base connecting the stator blade to the first frame;

a second frame supporting a second plurality of stator blades, each stator blade in the second plurality of stator blades having a base connecting the stator blade to the second frame;

wherein superposition portions of the first and second frames are superimposed in a direction along the axis of the rotor, the superposition portions are provided with release means for releasing a gas or fluid in the superposition portions; and the release means penetrates through the first frame or the second frame in a direction of the axis of the rotor.

4. The stator blade assembly according to claim 3, wherein the release means is constituted by a notch formed in one of the frames.

5. The stator blade assembly according to claim 3, wherein the release means is constituted by a hole formed in one of the frames.

6. The stator blade assembly according to claim 3, wherein the release means is constituted by a release slit formed in one of the frames.

7. The stator blade assembly according to claim 3, wherein the release means is constituted by a recess formed in one of the frames.

8. The stator blade assembly according to claim 3, wherein a caulked portion is provided in one of the frames.

9. An exhaust pump comprising the stator blade assembly according to claim 3.

* * * * *